US008174450B2

(12) United States Patent
Tatarnikov et al.

(10) Patent No.: US 8,174,450 B2
(45) Date of Patent: May 8, 2012

(54) BROADBAND MICROPATCH ANTENNA SYSTEM WITH REDUCED SENSITIVITY TO MULTIPATH RECEPTION

(75) Inventors: Dmitry Tatarnikov, Moscow (RU); Andrey Astakhov, Moscow (RU); Sergey Emelianov, Moscow (RU); Anton Stepanenko, Dedovsk (RU)

(73) Assignee: Topcon GPS, LLC, Oakland, NJ (US)

( * ) Notice: Subject to any disclaimer, the term of this patent is extended or adjusted under 35 U.S.C. 154(b) by 252 days.

(21) Appl. No.: 12/418,656

(22) Filed: Apr. 6, 2009

(65) Prior Publication Data

US 2009/0273522 A1 Nov. 5, 2009

Related U.S. Application Data

(60) Provisional application No. 61/125,935, filed on Apr. 30, 2008.

(51) Int. Cl.
*H01Q 1/38* (2006.01)
*H01Q 1/42* (2006.01)

(52) U.S. Cl. ..... 343/700 MS; 343/789; 343/846

(58) Field of Classification Search ..... 343/700 MS, 343/789, 846

See application file for complete search history.

(56) References Cited

U.S. PATENT DOCUMENTS

| | | | | |
|---|---|---|---|---|
| 5,990,835 | A | 11/1999 | Kuntzsch et al. | |
| 6,049,309 | A | 4/2000 | Timoshin et al. | |
| 6,091,373 | A * | 7/2000 | Raguenet | 343/778 |
| 6,211,824 | B1 | 4/2001 | Holden et al. | |
| 2007/0205945 | A1 | 9/2007 | Tatarnikov et al. | |

FOREIGN PATENT DOCUMENTS

| | | |
|---|---|---|
| EP | 0 481 417 | 4/1992 |
| EP | 1 684 381 | 10/2008 |
| WO | WO99/66594 | 12/1999 |
| WO | WO2005/117208 | 12/2005 |

OTHER PUBLICATIONS

Gonzalez Miguel A et al., "Analysis of Cavity-Backed Multilayer Microstrip Patch Arrays on Continuous Dielectric Substrates by a Hybrid Modular Technique", European Microwave Conference, 2001, 31st IEEE, Piscataway, N.J., Oct. 1, 2001, pp. 1-4.

International Search Report corresponding to International Application No. PCT/IB2009/005405 filed Apr. 24, 2009, (4 pages).

Written Opinion of the International Searching Authority corresponding to International Application No. PCT/IB2009/005405 filed Apr. 24, 2009 (10 pages).

* cited by examiner

*Primary Examiner* — Hoang V Nguyen
(74) *Attorney, Agent, or Firm* — Wolff & Samson PC

(57) ABSTRACT

A micropatch antenna system with simultaneous high bandwidth and low sensitivity to multipath radiation is achieved by positioning a radiating element within a cavity in a ground plane. Bandwidth and sensitivity to multipath radiation may be varied by varying the height of the radiating element above the bottom of the cavity and above the top of the ground plane. The electromagnetic and physical characteristics of the antenna system may be further controlled by introducing dielectric solids or wave-slowing structures between the bottom of the cavity and the radiating element. A dual-band micropatch antenna system with simultaneous high bandwidth and low sensitivity to multipath radiation may be similarly configured by stacking a second radiating element on top of the first radiating element.

24 Claims, 11 Drawing Sheets

BROADBAND MICROPATCH ANTENNA SYSTEM WITH REDUCED SENSITIVITY TO MULTIPATH RECEPTION

This application claims the benefit of U.S. Provisional Application No. 61/125,935 filed Apr. 30, 2008, which is incorporated herein by reference.

BACKGROUND OF THE INVENTION

The present invention relates generally to antennas, and more particularly to broadband micropatch antenna systems with reduced sensitivity to multipath reception.

Micropatch antennas (MPAs) are widely deployed in global navigation satellite system (GNSS) receivers. Relative to other antenna designs, they are small and lightweight, and they may be manufactured in high volumes at low cost. The basic elements of a conventional MPA are a flat radiating element (patch) and a flat ground plane separated by a dielectric medium. The resonant size of a MPA is a function of the wavelength of the radiation propagating in the dielectric medium between the radiating element and the ground plane. The resonant size is approximately half of the wavelength. The resonant size may be reduced by increasing the permittivity of the dielectric medium or by introducing wave-slowing structures. Reducing the resonant size also yields a wider antenna pattern, which is advantageous for some applications.

The size of an MPA is also determined by other design considerations. In conventional MPAs, the size of the ground plane is typically greater than or equal to $\lambda$, where $\lambda$ is the free-space wavelength of the radiation of interest. A large ground plane is used to reduce signals reflected from the terrain below the antenna. Furthermore, in an MPA, the bandwidth increases with the height of the radiating element above the ground plane. To achieve a bandwidth of 12% or more, the height is ~(0.10-0.15)$\lambda$. Here, the bandwidth is specified as percentage of the central frequency corresponding to $\lambda$. In addition to increasing the overall size of the antenna, however, the required height also results in an increased radiation pattern in the backward hemisphere and higher sensitivity to multipath reception. High sensitivity to multipath reception becomes significant when the length of the ground plane is on the order of 1-1.5 wavelengths.

FIG. 1 shows one prior-art micropatch antenna design for reducing sensitivity to multipath reception. The micropatch antenna is a microstrip antenna formed on dielectric substrate 110. Positioned on top of dielectric substrate 110 are patch antenna elements 104. Positioned underneath the dielectric substrate 110 is a ground plane 102, which includes edge ground elements 108. Coaxial feed-point 106 connects to the patch antenna elements 104. A short-maker (not shown) connects together the patch antenna elements 104 with the ground plane 102.

Edge ground elements 108 form a vertical rim near the edge of the dielectric substrate 110 and project above the top surface of dielectric substrate 110. In one embodiment, parts of edge ground elements 108 include conducting through holes located near the edge of the dielectric substrate 110. The spacing between the holes is a defined value much smaller than a wavelength. Presumably, the design of edge ground elements 108 causes substantial filtration of multipath radiation propagated from below the horizon. This prior-art micropatch antenna design, however, suffers a major disadvantage: reduction in sensitivity to multipath reflection is inefficient in the case of a broadband radiator with lengths of the ground plane on the order of 1-1.5 wavelengths. Higher bandwidth is achieved by increasing the height of patch antenna elements 104 above ground plane 102, resulting in higher sensitivity to multipath reflection.

What is needed is a broadband micropatch antenna system with small size, wide bandwidth, and low sensitivity to multipath reception.

BRIEF SUMMARY OF THE INVENTION

In an embodiment of the present invention, a broadband micropatch antenna system has a ground plane comprising a first surface and a cavity. The cavity comprises a second surface and a sidewall surface. A radiating element is laterally positioned within the cavity and has a height from the first surface and a height from the second surface. Simultaneous high bandwidth and low sensitivity to multipath radiation may be achieved by varying the height from the first surface and the height from the second surface. In an advantageous embodiment, the height from the second surface is no greater than 0.05$\lambda$, wherein $\lambda$ is the free-space wavelength. In another embodiment of the invention, a dual-band micropatch antenna system with simultaneous high bandwidth and low sensitivity to multipath radiation is achieved by stacking a second radiating element on top of the first radiating element.

These and other advantages of the invention will be apparent to those of ordinary skill in the art by reference to the following detailed description and the accompanying drawings.

DETAILED DESCRIPTION

Figure 1:
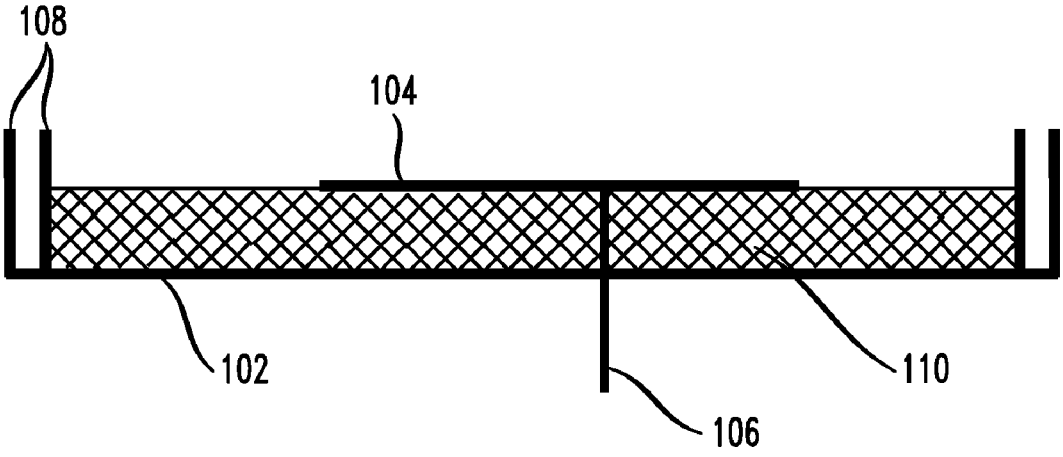
FIG. 1 PRIOR ART
FIG. 1 shows a prior-art design for a micropatch antenna.
Figure 2:
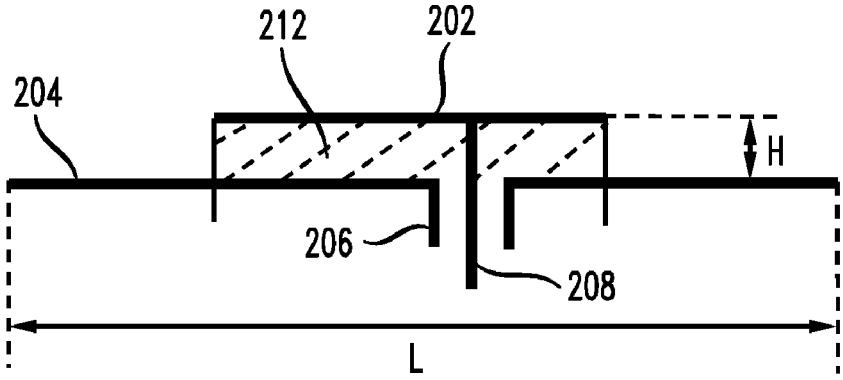
FIG. 2 shows a schematic of a micropatch antenna.

FIG. 2 shows a basic cross-sectional view of a conventional micropatch antenna. The flat radiating element (patch) 202 is separated from the flat ground plane 204 by a dielectric medium 212. Dielectric medium 212, for example, may be an air gap or a solid dielectric substrate. If the dielectric medium 212 is an air gap, the radiating element 202 and the ground plane 204 may be held together by standoffs, such as ceramic posts (not shown). The length of ground plane 204 is L. The height of radiating element 202 above ground plane 204 is H. If the dielectric medium 212 is air, the height H is equivalent to the air-gap spacing between radiating element 202 and ground plane 204. If the dielectric medium 212 is a solid dielectric substrate, the height H is equivalent to the thickness of the solid dielectric substrate.

Signals are transmitted to and from the micropatch antenna via a radiofrequency (RF) transmission line. In the example shown in FIG. 2, signals are fed to the radiating element 202 via a coaxial cable. The outer conductor 206 is electrically connected to the ground plane 204, and the center conductor 208 is electrically connected to the radiating element 202. Electromagnetic signals are fed to the radiating element 202 via the center conductor 208. Electrical currents are induced on both the radiating element 202 and the ground plane 204.

The resonant size of the micropatch antenna is determined by the wavelength of the radiation being propagated in the dielectric medium 212 between radiating element 202 and ground plane 204. The resonant size is approximately equal to half of the wavelength in the dielectric medium 212. To decrease the wavelength in the dielectric medium 212, the permittivity of dielectric medium 212 may be increased or wave-slowing structures may be introduced between radiating element 202 and ground plane 204. Through these means, the antenna pattern may be widened and the resonant size may be decreased.

Figure 3:
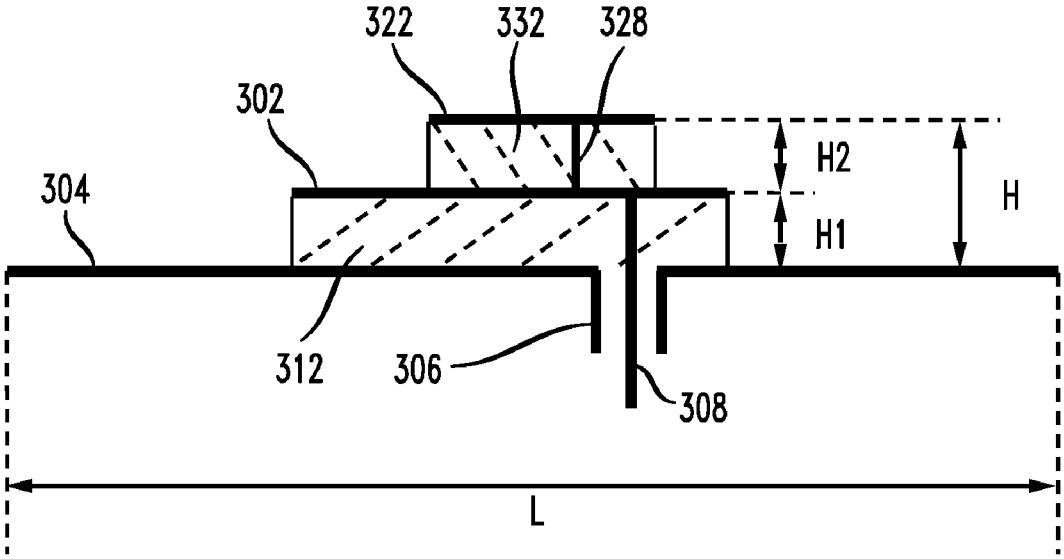
FIG. 3 shows a schematic of a dual-band micropatch antenna.

FIG. 3 shows a cross-sectional view of a dual-band stacked micropatch antenna that operates in two frequency bands. The configuration for the low-frequency band is similar to the one shown in FIG. 2. Radiating element 302 is separated from ground plane 304 by dielectric medium 312, which, for example, may be air or a solid. Signals are transmitted to and from the micropatch antenna via a RF transmission line. In the example shown in FIG. 3, signals are fed to the radiating element 302 via a coaxial cable. The outer conductor 306 is electrically connected to the ground plane 304, and the center conductor 308 is electrically connected to the radiating element 302.

For the high-frequency band, radiating element 322 is separated from radiating element 302 by dielectric medium 332, which, for example, may be air or a solid. Radiating element 322 is fed by conducting probe 328 electrically connected to radiating element 302, which serves as the ground plane for radiating element 322. As discussed above, radiating element 302 and ground plane 304 may be held together by standoffs (such as ceramic posts); similarly, radiating element 322 and radiating element 302 may be held together by standoffs. As shown in FIG. 3, the length of ground plane 304 is L; the height of radiating element 302 above ground plane 304 is H1; the height of radiating element 322 above radiating element 302 is H2; and the total height of radiating element 322 above ground plane 304 is H=H1+H2.

Figure 4:
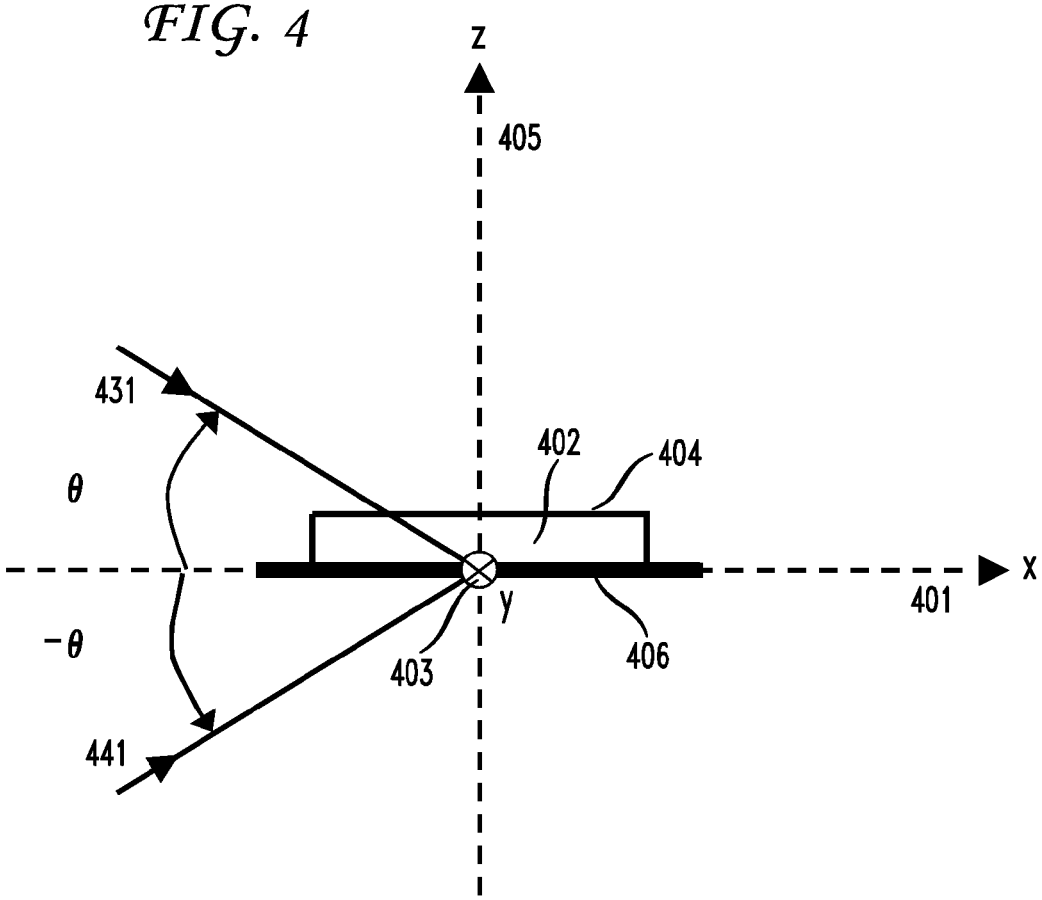
FIG. 4 shows a reference Cartesian coordinate system for down/up ratio.

FIG. 4 shows the geometrical orientation of a single-band micropatch antenna with respect to a Cartesian coordinate system specified by the x-axis 401, y-axis 403, and z-axis 405. The +y direction points into the plane of the figure. In an open-air environment, the +z (up) direction (zenith) points towards the sky, and the −z (down) direction points towards the Earth. Herein, the term Earth includes both land and water environments. To avoid confusion with "electrical" ground (as used in reference to ground plane), "geographical" ground (as used in reference to land) is not used herein. In FIG. 4, the micropatch antenna 402 includes radiating element 404 and ground plane 406. In this example, ground plane 406 is larger than radiating element 404. To simplify the figure, other components, such as the coaxial cable feed, dielectric medium, and standoffs, are not shown.

In FIG. 4, electromagnetic waves are represented as rays, incident upon the micropatch antenna 402 at an incident angle θ with respect to the x-axis 401. The horizon corresponds to θ=0 deg; the zenith corresponds to θ=90 deg. Rays incident from the open sky, such as ray 431, have positive values of incident angle. Rays reflected from the Earth, such as ray 441, have negative values of incident angle. Herein, the region of space with positive values of incident angle is referred to as the direct signal region and is also referred to as the forward hemisphere. Herein, the region of space with negative values of incident angle is referred to as the multipath signal region and is also referred to as the backward hemisphere.

To characterize numerically the capability of an antenna to mitigate the reflected signal, the following ratio is commonly used:

$$D/U(\theta) = \frac{F(-\theta)}{F(\theta)}.$$

The parameter D/U(θ) (down/up ratio) is equal to the ratio of the antenna pattern level F(−θ) in the backward hemisphere to the antenna pattern level F(θ) in the forward hemisphere at the mirror angle, where F represents a voltage level.

Referring back to FIG. 2, the bandwidth of the single-band micropatch antenna is a function of the height H of radiating element 202 above ground plane 204. The bandwidth increases with increasing H. For a bandwidth on the order of 12%, the height H is approximately (0.10-0.15)λ. Herein, the bandwidth is specified as percentage of the central frequency corresponding to λ, where λ is the free-space wavelength of the radiation radiated by the antenna. To simplify the terminology herein, the free-space wavelength of the radiation radiated by the antenna is referred to as the free-space wavelength of the antenna and is also referred to as the free-space wavelength of the antenna system (if the antenna is considered to be part of an antenna system). As the height H increases, however, the micropatch antenna becomes more sensitive to multipath reception. If the length L of the ground plane 204 is in the range of (1.0-1.5)λ, then a height H greater than a threshold value H' (H'≈0.05λ) causes an undesirable increase in the antenna pattern in the backward hemisphere, as well as a pattern weakening in the forward hemisphere. The D/U(θ=90°) ratio degrades as L approaches 1.5λ, and as the threshold value H' decreases. For GPS applications, it is important to provide the desired down/up ratio characteristic for the angles close to θ=90°. To reduce the effects of multipath reception, a flat ground plane of large size L is used. An increase in the height H of radiating elements over the ground plane is often necessary to expand the antenna bandwidth, as well as to form multifrequency stacked structures. Similar geometrical considerations apply for the dual-band micropatch antenna shown in FIG. 3.

The directional-response characteristics of a micropatch antenna may be analyzed according to the following mathematical model. To a first approximation, the resonant size of the radiating element is sufficiently small that the radiation field may be considered to be generated by slots formed by the edges of the radiating element and ground plane. This approximation holds, for example, for wide-directional antennas with a dielectric substrate having a high permittivity or with a dielectric substrate fabricated from artificial dielectric structures with a high slowness factor. Wave-slowing structures may also be used when the dielectric medium is air (see further discussion below).

Figure 5A:
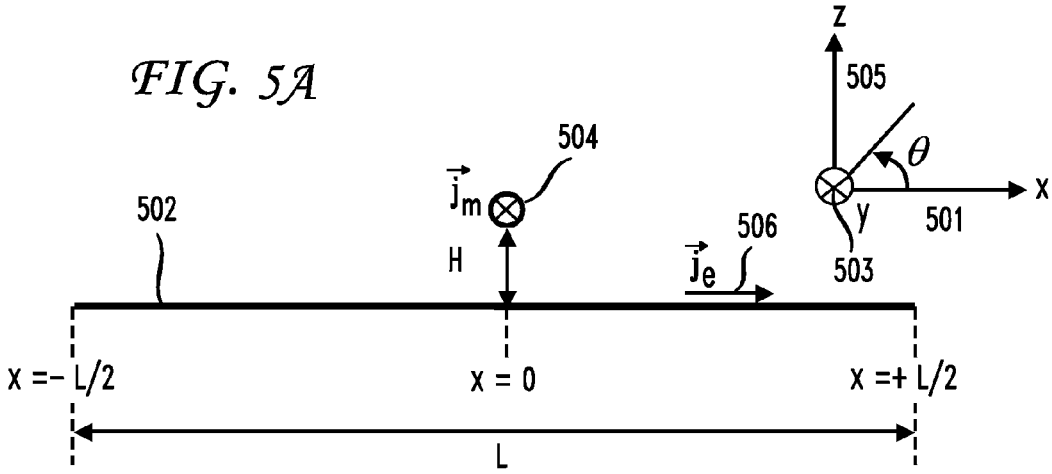
FIG. 5A and FIG. 5B show schematics of a mathematical model for a micropatch antenna.

In FIG. 5A, the reference Cartesian coordinate system is specified by the x-axis 501, y-axis 503, and z-axis 505. The +y direction points into the plane of the figure. The angle θ is measured from x-axis 501. In a two-dimensional approximation, the antenna pattern can be estimated by a model in the form of a filamentary magnetic current $\vec{j}_m$ 504 located at a height H above a ground plane 502 with a length L, through which electric current $\vec{j}_e$ 506 flows. The $\vec{j}_m$ vector points along the y-axis 503, and the $\vec{j}_e$ vector points along the x-axis 501.

From an analysis based on physical optics, the electric field of the system may be expressed as:

$$\vec{E}(\theta) = \vec{E}(j_m, \theta) + \int_{-\frac{L}{2}}^{\frac{L}{2}} j_{ex}(x)\vec{E}_e(x, \theta)\,dx, \tag{E1}$$

where:

$\vec{E}(\theta)$ is the electric field at an angle θ;

$\vec{E}(j_m,\theta)$ is the electric field of filamentary magnet current $\vec{j}_m$ in free space;

$$\int_{-\frac{L}{2}}^{\frac{L}{2}} j_{ex}(x)\vec{E}_e(x, \theta)\,dx$$

is the electric field of electric current $\vec{j}_e$ describing the influence of the ground plane; and $\vec{E}_e$ is the electric field of a filamentary electric source at point x.

The current $\vec{j}_e$ is assumed to be equal to the current induced by the source $\vec{j}_m$ in an infinite ground plane:

$$j_e = x_0 U \frac{k}{2W} H_0^{(2)}(k\sqrt{x^2 + H^2}), \tag{E2}$$

where:

$H_0^{(2)}$ is the zeroth-order Hankel function of the second kind;

W=120π is the wave resistance of free space;

U is the voltage at the slot which is described by the filamentary magnetic current;

$$k = \frac{2\pi}{\lambda}$$

is the wave number;

x is the coordinate of an observation point; and $\overline{x_0}$ is the unit vector along the x-axis: $\vec{j}(x)=\vec{x}_0 j_x(x)$.

The antenna pattern for this system is then expressed as the following:

$$F(\theta) = e^{ikH\sin(\theta)} + \sin(\theta)\frac{k}{2}\int_{-\frac{L}{2}}^{\frac{L}{2}} H_0^{(2)}(k\sqrt{x^2 + H^2})e^{ikx\cos(\theta)}\,dx. \tag{E3}$$

Figure 5B:
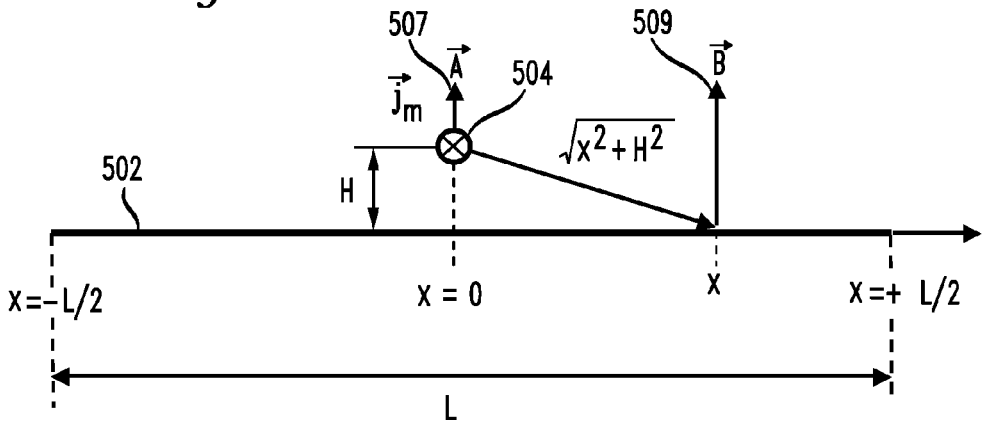

For efficient radiation in the upward (+z) direction (see FIG. 5B), the electric fields formed by the sources $\vec{j}_m$ and each current element $\vec{j}_e$ should be added in phase. $\vec{A}$ 507 and $\vec{B}$ 509 indicate the local normal (upward) vectors at x=0, z=H and x=x, z=0, respectively. For x/λ>0.15, the phase of the induced electric current varies as $$-\left(k\sqrt{x^2 + H^2} - \frac{\pi}{4}\right).$$

(Here the asymptotic behavior for the Hankel function $H_0^{(2)}(x)$ has been used). Then the phase difference between the field of $j_m$ and the field of a current element $j_e(x)$, whose distance from the origin is x/λ>0.15, can be approximated as:

$$\Delta\varphi(x) = k\left(\sqrt{x^2 + H^2} + H\right) - \frac{\pi}{4}. \tag{E4}$$

From (E4), it is evident that as the height H increases, the phase difference between the magnetic current field and electric current elements field increases. The resulting sum is therefore non-optimal, and the ratio D/U worsens (increases) at θ=90°.

As x varies from −L/2 to L/2, it follows from (E4) that, starting from a certain length L, there will be certain values of current $\vec{j}_e$ which may generate an electric field opposite to the electric field generated by $\vec{j}_m$. At these values, the antenna pattern in the forward hemisphere weakens, and further degradation of the down/up ratio will occur. At small H, these values occur starting from $$L_{th} = \frac{5}{4}\lambda,$$

and as height H increases, antipodal current areas occur at a smaller length of the ground plane.

Figure 6:
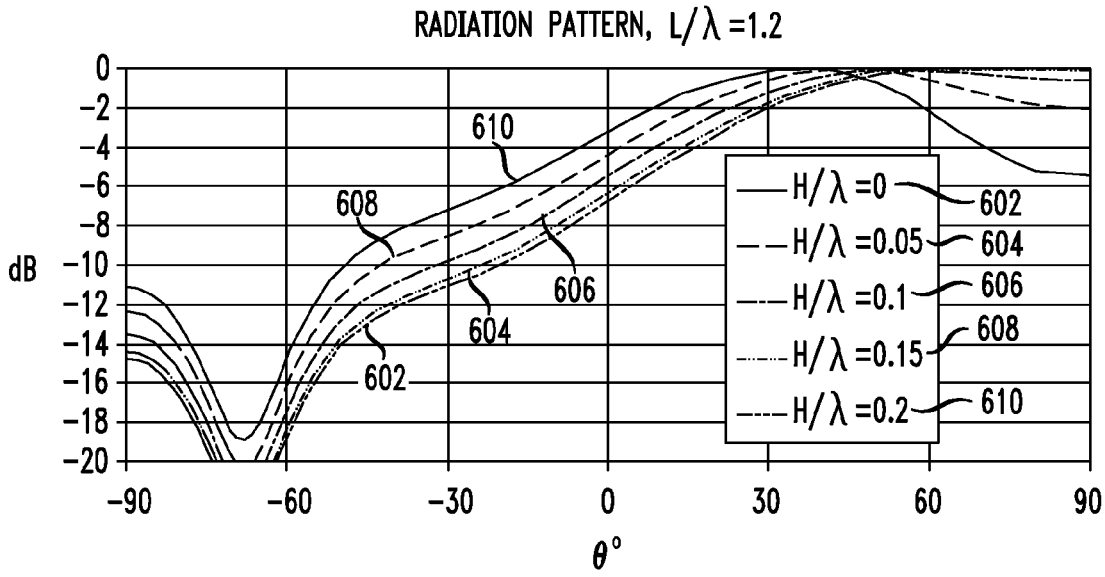
FIG. 6 shows plots of radiation pattern as a function of angle.
Figure 7:
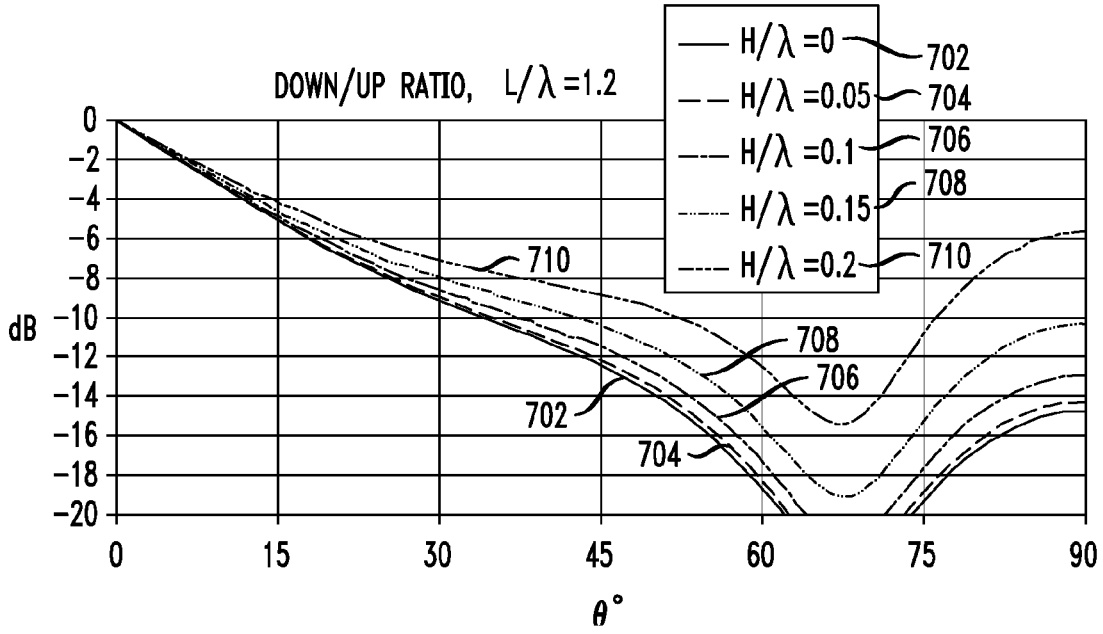
FIG. 7 shows plots of down/up ratio as a function of angle.
Figure 8:
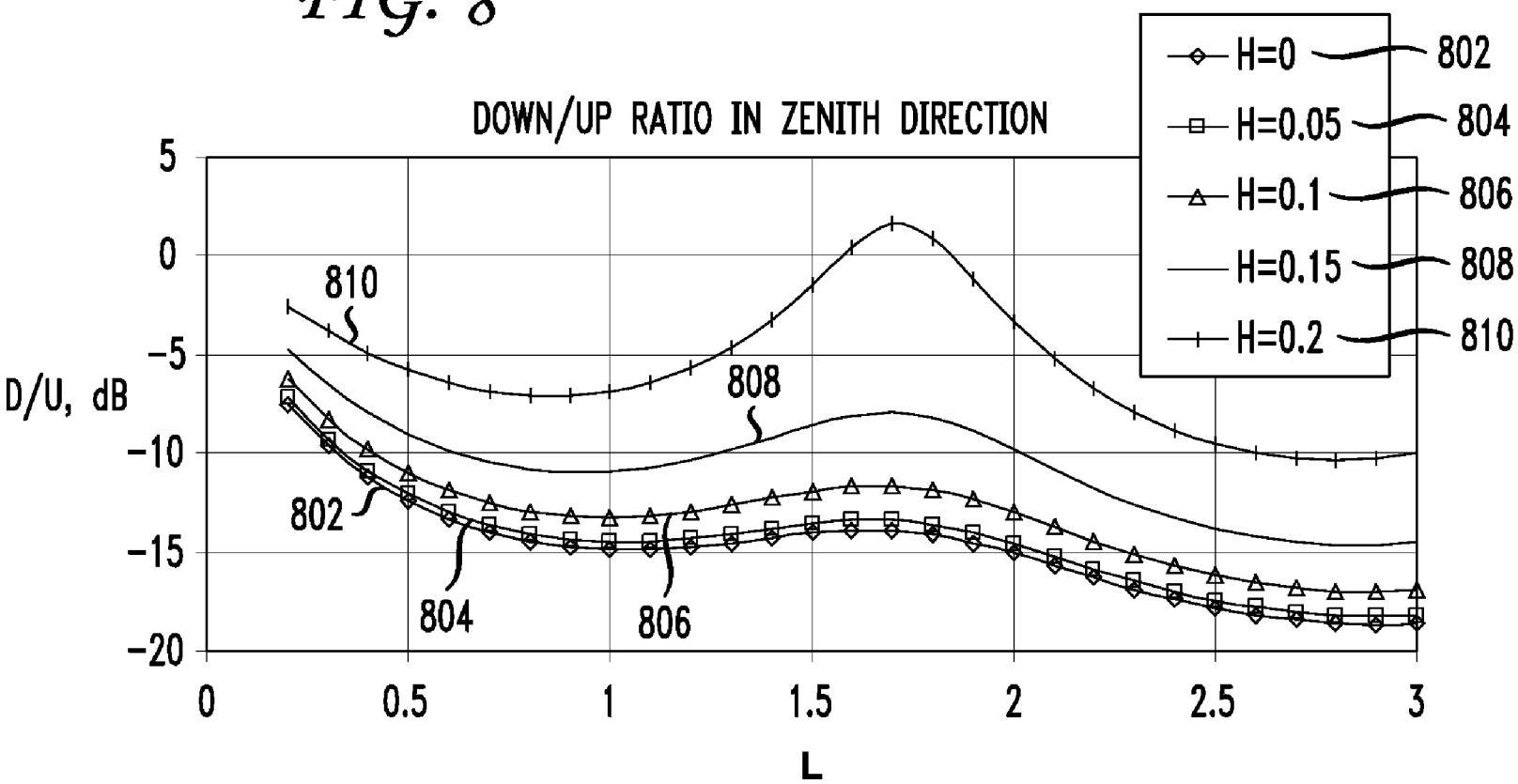
FIG. 8 shows plots of the down/up ratio D/U(90) as a function of ground plane length.

FIG. 6 shows plots of the radiation pattern for L/λ=1.2. Shown are plots of the radiation pattern [dB(Power)] as a function of angle θ for values of H/λ ranging from 0 to 0.2. A pattern minimum for θ=90° in the forward hemisphere occurs. FIG. 7 shows corresponding plots of the down/up ratio. The D/U ratio increases as θ approaches 90°. FIG. 8 shows plots of D/U(90) ratio (θ=90°) as a function the ground plane length L for different heights H. Values of L and H are normalized to units of λ. The acceptable value of D/U(90) ratio is dependent on the application and is a user-specified value. In some applications, such as GPS, it is desirable to maintain a D/U(90) ratio no less than −15 dB. For these applications, as seen from the plots, H should be no greater than 0.05λ.

Figure 11A:
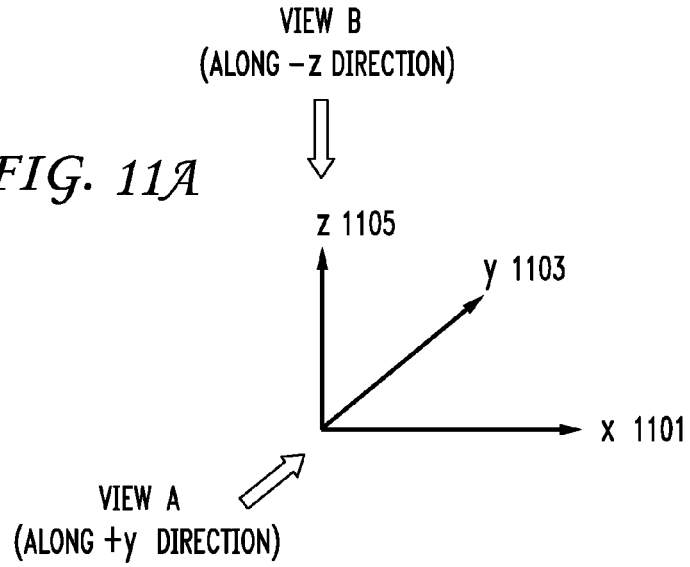
FIG. 11A shows a reference Cartesian coordinate system for broadband micropatch antenna systems.

FIG. 11A shows a reference Cartesian coordinate system used in illustrations below of broadband micropatch antenna systems according to embodiments of the invention. The reference Cartesian coordinate system, shown in perspective view, is specified by the x-axis 1101, y-axis 1103, and z-axis 1105. In FIGS. 11B-11E, 12, and 13 shown below, "View A" is the view along the +y direction, and "View B" is the view along the −z direction.

Figure 11B:
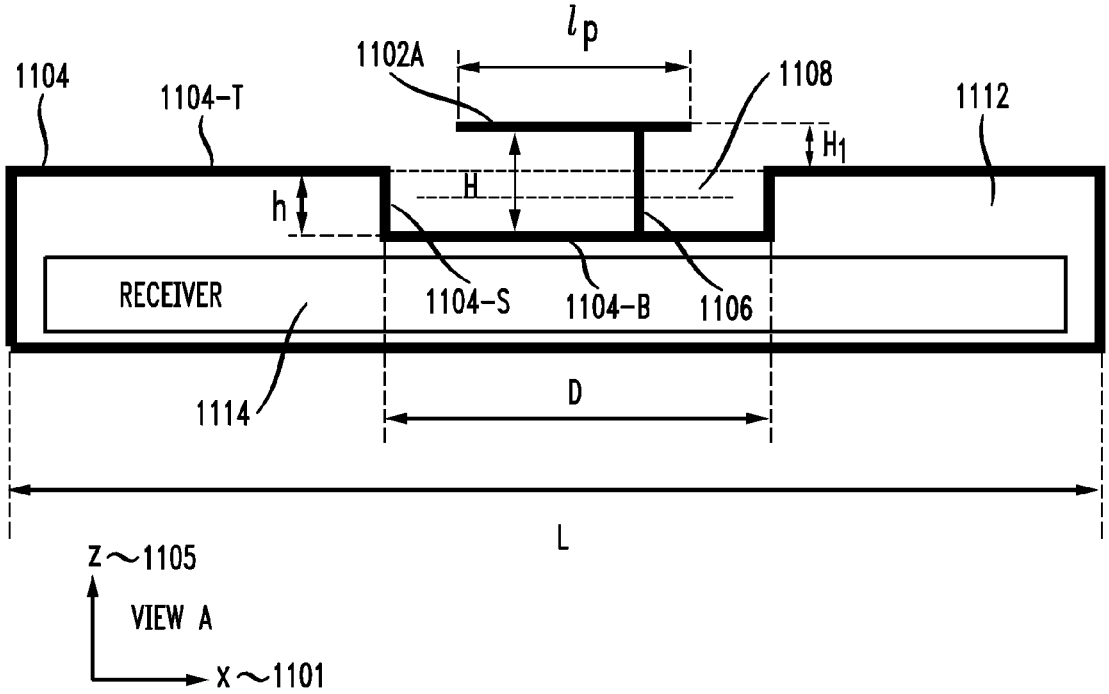
FIG. 11B-FIG. 11E show schematics of broadband micropatch antenna systems according to embodiments of the invention.

FIG. 11B shows (View A) a broadband micropatch antenna system, according to an embodiment of the invention, that reduces sensitivity to multipath reception. The broadband micropatch antenna system comprises antenna block 1112, which has a cavity 1108. Herein, an antenna block is also referred to as a case. Compared to the conventional micropatch antenna shown in FIG. 2, the ground plane 1104 is no longer flat: it has a top surface 1104-T, a sidewall surface 1104-S, and a bottom surface 1104-B. The cavity 1108 refers to the space bounded by the sidewall surface 1104-S and the bottom surface 1104-B. Note that the sidewall surface 1104-S is not necessarily perpendicular. The slope is dependent on the application and is user-defined. Herein, the sidewall surface is also referred to as the cavity wall. Herein, the bottom surface 1104-B is also referred to as the cavity bottom. The height (also referred to as the depth) of the cavity 1108 is h.

A radiating element 1102A, with length $l_p$, is laterally positioned (see discussion below) within the cavity 1108. The height of radiating element 1102A above the bottom surface 1104-B is H. The height of radiating element 1102A above the top surface 1104-T is $H_1$. In an embodiment of the invention, the height $H_1$ does not exceed 0.05λ. For this design, the frequency characteristics are generally determined by height H. The antenna pattern is determined by height $H_1$ and length of the ground plane L.

Figure 11C:
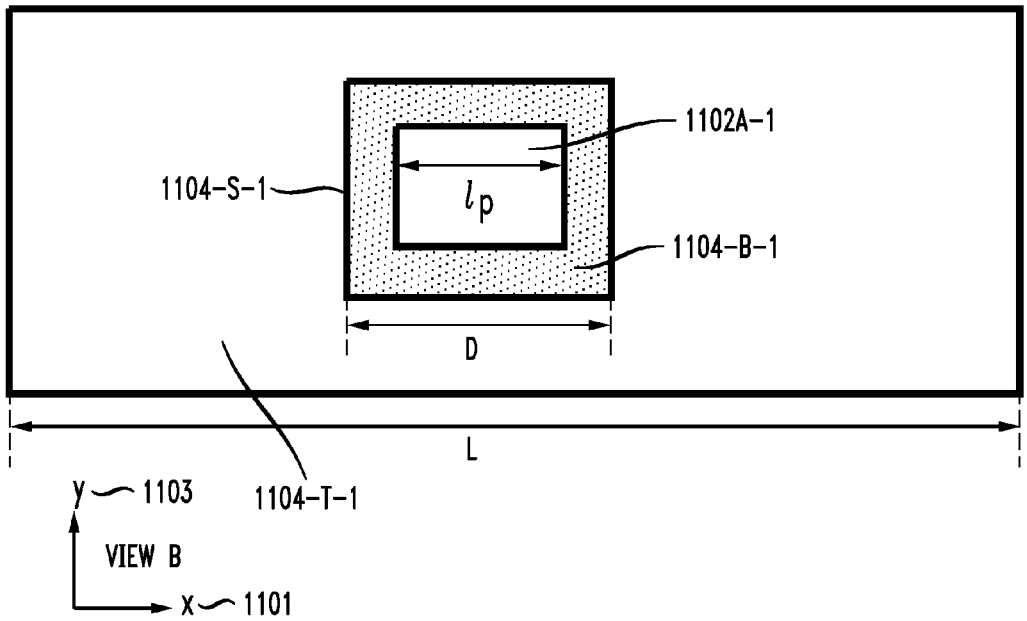

FIG. 11C shows View B of one broadband micropatch antenna system corresponding to View A in FIG. 11B. The top surface is designated 1104-T-1; the sidewall surface is designated 1104-S-1; and the bottom surface is designated 1104-B-1. In FIG. 11C, the top surface 1104-T-1 of ground plane 1104 has a rectangular geometry with a length L. In general, the top surface 1104-T-1 may have a two-dimensional geometry which is user-specified for a particular application. For example, the geometry may be square, rectangular, polygonal, circular, or elliptical. In general, the length L represents a value characterizing a lateral dimension of the top surface 1104-T-1. Lateral positions and lateral dimensions are specified with respect to the x-y plane.

In FIG. 11C, bottom surface 1104-B-1 has a rectangular geometry with a length D. In general, the bottom surface 1104-B-1 may have a two-dimensional geometry which is user-specified for a particular application. For example, the geometry may be square, rectangular, polygonal, circular, or elliptical. In general, the length D represents a value characterizing a lateral dimension of the bottom surface 1104-B-1.

In FIG. 11C, radiating element 1102A-1 has a rectangular geometry with a length $l_p$. In general, the radiating element 1102A-1 may have a two-dimensional geometry which is user-specified for a particular application. For example, the geometry may be square, rectangular, polygonal, circular, or elliptical. In general, the length $l_p$ represents a value characterizing a lateral dimension of the radiating element 1102A-1. The lateral positioning between radiating element 1102A-1 and sidewall surface 1104-S-1 is user-specified for a particular application.

Figure 11D:
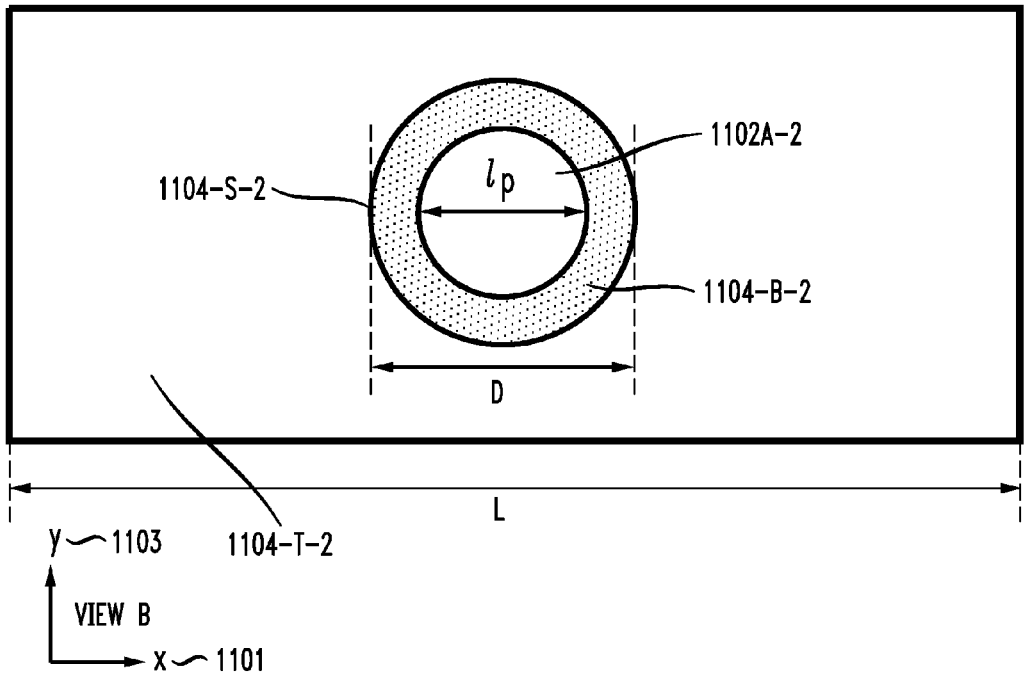

FIG. 11D shows View B of a second broadband micropatch antenna system corresponding to View A in FIG. 11B. The top surface is designated 1104-T-2; the sidewall surface is designated 1104-S-2; and the bottom surface is designated 1104-B-2. The top surface 1104-T-2 has a rectangular geometry with a lateral dimension L. The bottom surface 1104-B-2 has a circular geometry with a lateral dimension (diameter) D. The radiating element 1102A-2 has a circular geometry with a lateral dimension (diameter) $l_p$. The lateral positioning between radiating element 1102A-2 and sidewall surface 1104-S-2 is user-specified for a particular application.

Returning to FIG. 11B, during operation, electromagnetic signals are input to the radiating element 1102A via center conductor 1106 of a coaxial cable and cause electrical currents to be induced on both the radiating element 1102A and the ground plane 1104. Polarization currents are induced in the dielectric medium. The radiating element, ground plane, and dielectric medium all radiate electromagnetic waves in free space. The antenna assembly maintains a low height $H_1$ of the radiating element 1102A over the top surface 1104-T of ground plane 1104 to reduce sensitivity to multipath reception. At the same time, the height H of the radiating element 1102A over the bottom surface 1104-B of ground plane 1104 is sufficiently large to provide the required bandwidth. Measurements have shown that, when $H_1$ is about 0.05λ, radiation into the backward hemisphere is reduced, and high bandwidth is simultaneously realized.

The cavity 1108 may be filled with a dielectric medium, such as air or a dielectric solid. Similarly the entire space between the bottom surface 1104-B and radiating element 1102A may be filled with a dielectric medium. Wave-slowing structures (see further discussion below) may also be introduced on bottom surface 1104-B, on radiating element 1102A, or on both bottom surface 1104-B and radiating element 1102A.

Measurements have also shown that the diameter D of cavity 1108 affects antenna frequency characteristics. As discussed above, in general, D refers to a lateral dimension of cavity 1108, and not necessarily to the diameter of a circle. The diameter D is selected to balance the requirements of stable bandwidth and optimal down/up ratio. In an embodiment of the invention, the diameter D is determined by the algorithm:

$$\frac{D}{\lambda} \approx \frac{l_p}{\lambda} + C, \tag{E5}$$

where $l_p$ is the length of the radiating element 1102A, and C is a user-defined value ranging from approximately 0.1 to 0.2. Here, $$l_p = \frac{\lambda}{\sqrt{\varepsilon_{eff}}},$$

where $\in_{eff}$ is the effective permittivity of the dielectric medium. Typically, $l_p \leqq 0.5\lambda$. Note that effective permittivity takes into account the electromagnetic characteristics of any wave-slowing structures that may be present.

Figure 11E:
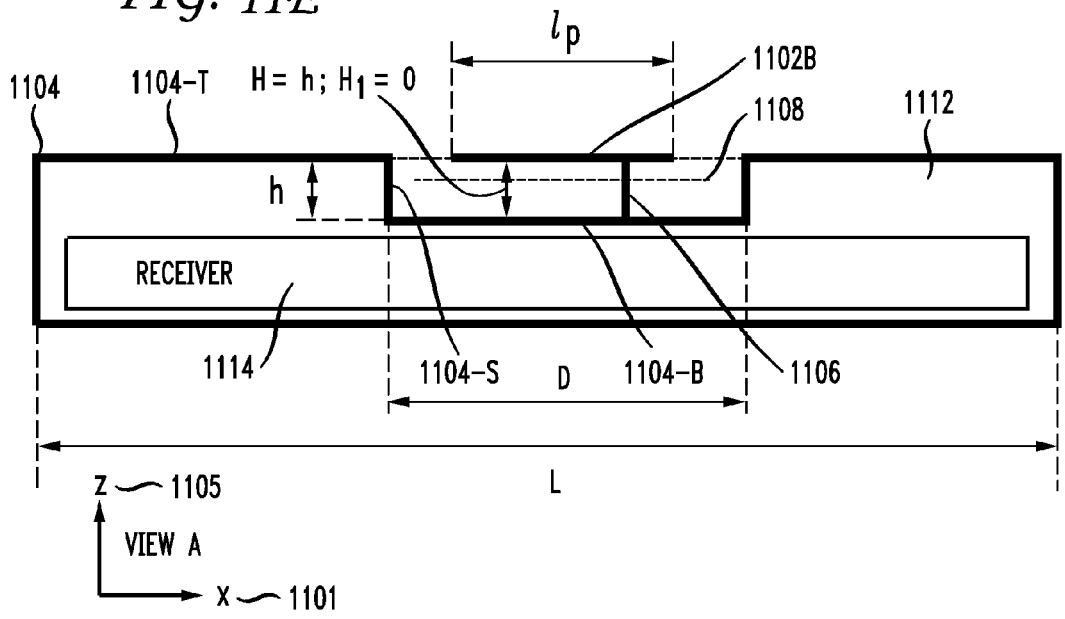

FIG. 11E shows an embodiment of the invention in which the radiating element 1102B is level with the top surface 1104-T of ground plane 1104; that is, H=h and $H_1$=0. In other embodiments of the invention, the radiating element 1102B may be below the top surface 1104-T. In these instances, the height $H_1$ may be considered to be negative. As noted in FIG. 11B and FIG. 11E, a receiver 1114 may be readily integrated into antenna block 1112, thereby keeping the overall dimensions small. Receiver 1114, for example, is a Global Navigation Satellite System (GNSS) receiver, such as a GPS, GLONASS, or Galileo receiver.

The broadband micropatch antenna systems shown in FIG. 11B and FIG. 11E are suitable for linearly-polarized radiation. Other embodiments of the invention may be configured for circularly-polarized radiation. In FIG. 11B and FIG. 11E, radiating element 1102A and radiating element 1102B, respectively, are fed by a single center conductor 1106. For circularly-polarized radiation, the radiating elements may be fed by two center conductors which excite two linearly-polarized fields orthogonally oriented in space.

Other embodiments of the invention may be adapted for a dual-band stacked antenna system. In the embodiment shown in FIG. 12, the basic configuration is similar to that of the single-band antenna system shown in FIG. 11B. Corresponding components have the same reference numbers. Radiating element 1102B, fed by conductive probe 1106 is the radiating element for the low-frequency band. Radiating element 1202, fed by conductive probe 1206, is the radiating element for the high-frequency band. The space between bottom surface 1104-B and radiating element 1102B may be filled with a dielectric medium, such as air or a dielectric solid. Similarly, the space between radiating element 1102B and radiating element 1202 may be filled with a dielectric medium. Conductive probe 1206 is electrically connected to radiating element 1102B, which also serves as the ground plane for radiating element 1202.

To achieve simultaneous broadband operation and optimal down/up ratio in both frequency bands, radiating element 1102B and radiating element 1202 are laterally positioned within cavity 1108. In this embodiment, the radiating element 1102B is level with the top surface 1104-T of ground plane 1104 (similar to the configuration in FIG. 11E). In other embodiments, the radiating element 1102B is raised above the top surface 1104-T of ground plane 1104 (similar to the configuration in FIG. 11B). The height of radiating element 1202 above the top surface 1104-T of ground plane 1104 is $H_2$, where $H_2 \approx 0.05\lambda$. As discussed above, the radiating element 102B and the radiating element 1202 may also be below the top surface 1104-T of ground plane 1104. The overall dimensions of the stacked antenna system are compact. In one embodiment, the dimensions are $H_2$=12 mm, h=22 mm, D=105 mm, and L=280 mm.

Figure 12:
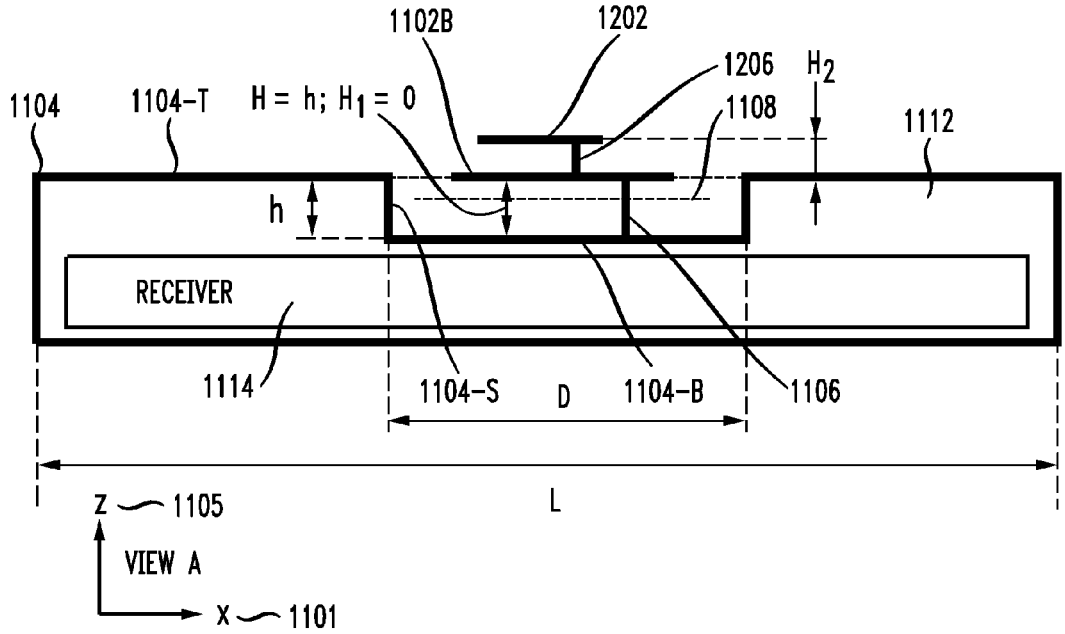
FIG. 12 shows a schematic of a dual-band micropatch antenna system according to an embodiment of the invention.
Figure 13:
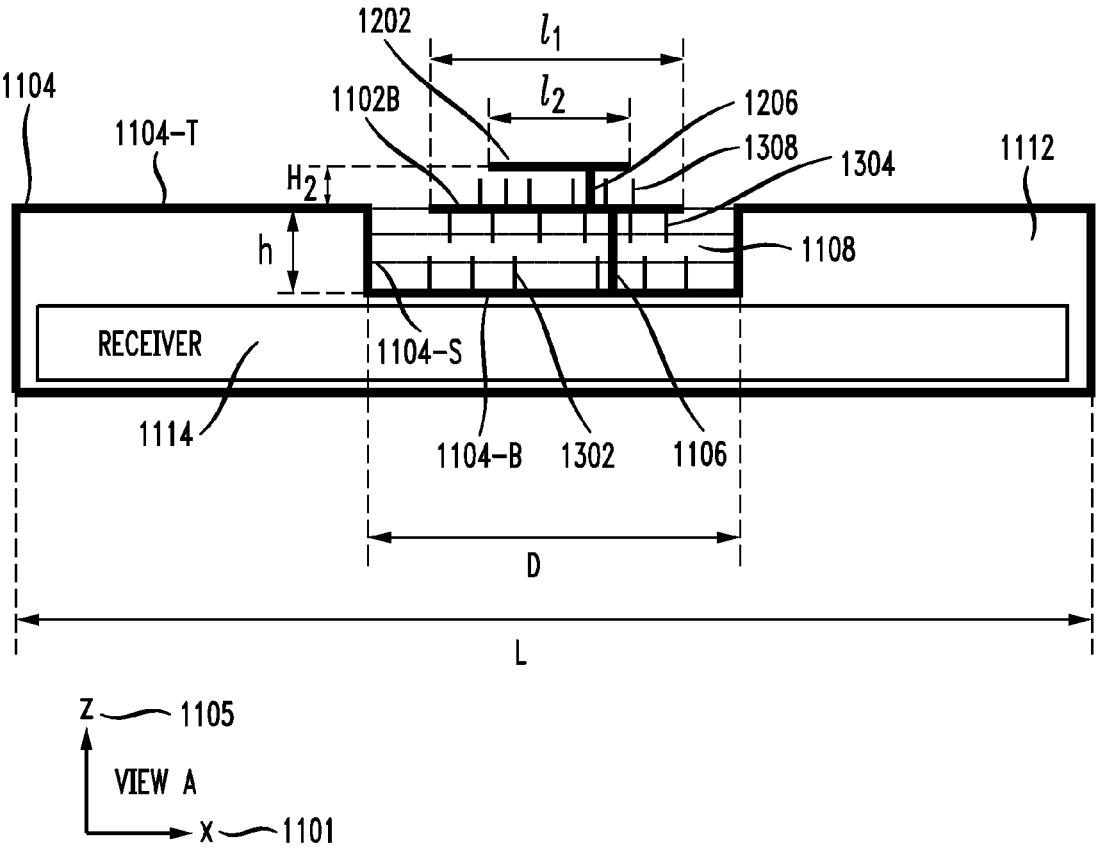
FIG. 13 shows a schematic of a dual-band micropatch antenna system with wave-slowing structures according to an embodiment of the invention.

Another embodiment of a dual-band antenna system is shown in FIG. 13. The configuration is similar to that shown in FIG. 12, except wave-slowing structures are added. Wave-slowing structures may be configured on the bottom surface 1104-B, on radiating element 1102B, and on radiating element 1202, either individually or in any combination thereof. Wave-slowing structures, for example, may comprise an array of pins or ribs on the surfaces of bottom surface 1104-B, radiating element 1102B, and radiating element 1202, as described in U.S. Patent Application Publication No. 2007/0205945 and European Patent Specification EP 1 684 381, both of which are incorporated by reference herein. Wave-slowing structures may also comprise extended continuous structures or series of localized structures along the perimeters of bottom surface 1104-B, radiating element 1102B, and radiating element 1202, as described in U.S. patent application Ser. No. 12/275,761, which is incorporated by reference herein.

In the example shown in FIG. 13, wave-slowing structures 1302 are configured on the bottom surface 1104-B; wave-slowing structures 1304 are configured along the perimeter of radiating element 1102B and projecting down towards the bottom surface 1104-B; and wave-slowing structures 1308 are configured along the perimeter of radiating element 1102B and projecting up towards radiating element 1202. In the example shown in FIG. 13, there are no wave-slowing structures configured on radiating element 1202 or along the perimeter of radiating element 1202, but in other designs, there may be.

The length L is typically 1-1.5λ, where λ is the free-space wavelength of the radiation emitted by radiator 1202 (high-frequency band). Herein, the free-space wavelength of the radiation emitted by radiator 1202 is also referred to as the free-space wavelength of the high-frequency band. For applications such as GPS, the height $H_2$ of radiating element 1202 above the top surface 1104-T of ground plane 1104 is no greater than 0.05λ. The height $H_1$ of radiating element 1102B above the top surface 1104-T of ground plane 1104 is selected to provide the appropriate low-frequency bandwidth. In the example shown in FIG. 13, $H_1$=0 and is not shown. The diameter D may be selected according to (E5) above. For the dual-band antenna, $l_p$ in (E5) refers to the length of radiating element 1202. In one embodiment, the low-frequency band is 1160-1300 MHz, and the high-frequency band is 1525-1610 MHz. Suitable dimensions are $H_2$=12 mm, h=22 mm, D=105 mm, L=280 mm, $l_1$=71 mm, and $l_2$=54 mm, where $l_1$ is the length of radiating element 1102B, and $l_2$ is the length of radiating element 1202. As shown in FIG. 12 and FIG. 13, a GNSS receiver may be integrated into antenna block 1112 to provide a compact overall dual-band antenna system.

Figure 9:
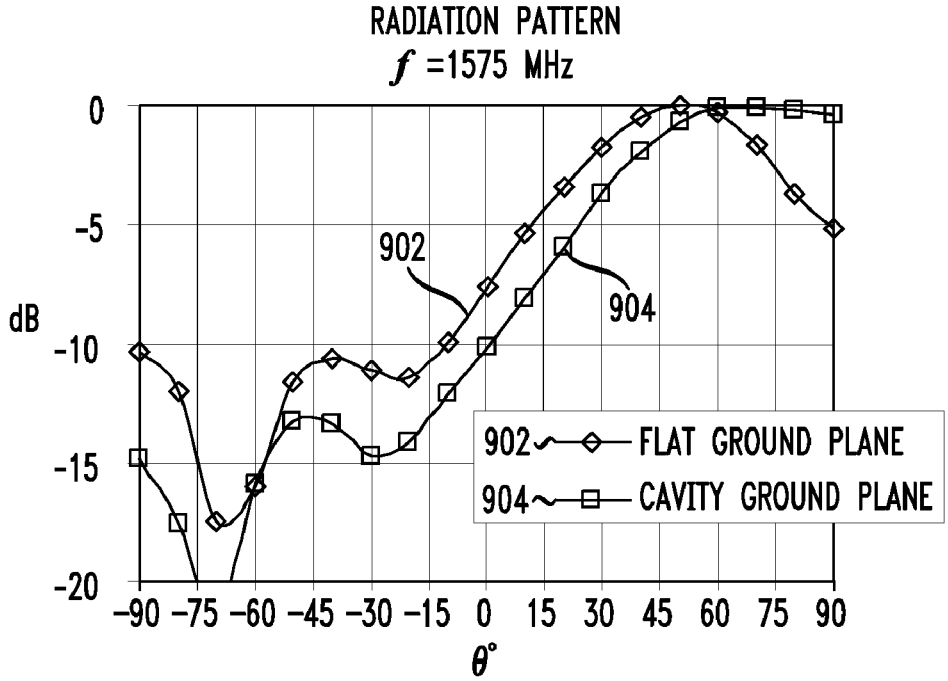
FIG. 9 shows plots comparing the radiation pattern as a function of angle for a flat ground plane vs. a cavity ground plane.
Figure 10:
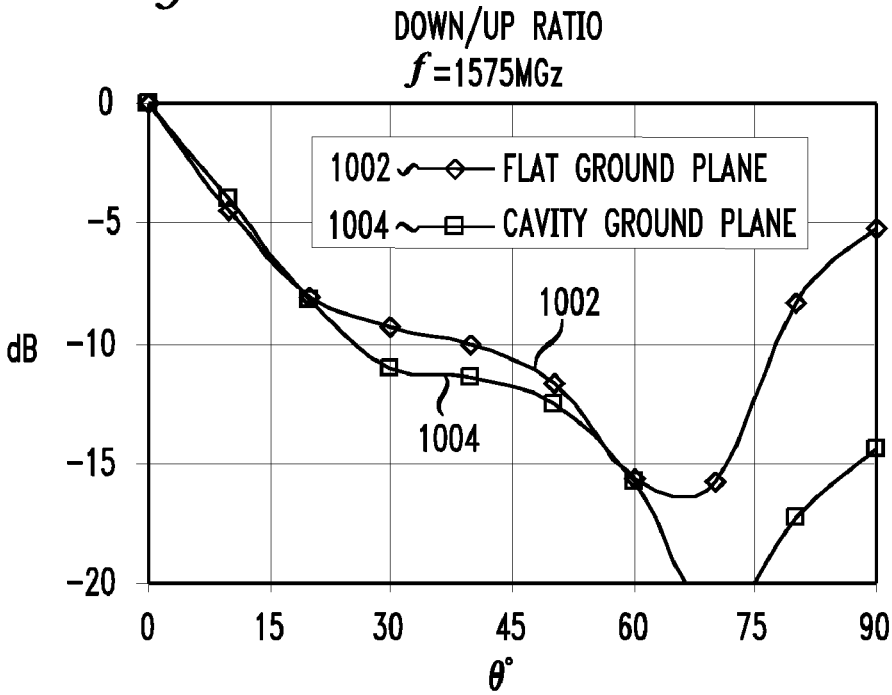
FIG. 10 shows plots comparing the down/up ratios as a function of angle for a flat ground plane vs. a cavity ground plane.

FIG. 9 and FIG. 10 show comparisons of antenna characteristics for a conventional stacked antenna with a flat ground plane (as shown in FIG. 2) and antenna characteristics for a stacked antenna for a ground plane with a cavity (as shown in FIG. 12). FIG. 9 shows plots of the measured radiation pattern at a frequency of 1575 MHz (the top radiating element is induced). Plot 902 shows the results for a flat ground plane; and plot 904 shows the results for a cavity ground plane. In plot 902 (flat ground plane), the radiation pattern weakens in the forward hemisphere as θexceeds ~60 deg. In plot 904 (cavity ground plane), however, the radiation pattern stays essentially flat out to 90 deg. FIG. 10 shows plots of the measured down/up ratio. Comparison of plot 1002 (flat ground plane) and plot 1004 (cavity ground plane) indicates improved (lower) down/up ratios for the cavity ground plane. The improvement is especially pronounced as θ approaches 90 deg.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A broadband micropatch antenna system comprising:

a ground plane comprising:

a first surface having a first lateral dimension; and a cavity filled with air, the cavity comprising:

a second surface having a second lateral dimension; and a sidewall surface having a first height; and a radiating element having a third lateral dimension, wherein the radiating element:

is laterally positioned within the cavity;

has a second height from the first surface, wherein:

the second height is greater than zero and no greater than 0.05λ, wherein λ is the free-space wavelength of the broadband micropatch antenna system; and has a third height from the second surface; and is separated from the ground plane by air; and a conductor connected to the radiating element and configured to input electromagnetic signals to the radiating element.

2. The broadband micropatch antenna system of claim 1, wherein:

the first lateral dimension is approximately (1-1.5)λ, wherein λ is the free-space wavelength of the broadband micropatch antenna system.

3. The broadband micropatch antenna system of claim 1, wherein:

the second lateral dimension is specified according to the algorithm:

$$\frac{D}{\lambda} \approx \frac{l_p}{\lambda} + C,$$

wherein:

D is the second lateral dimension;

$l_p$ is the third lateral dimension;

C is a user-defined value; and

λ is the free-space wavelength of the broadband micropatch antenna system.

4. The broadband micropatch antenna system of claim 3, wherein the user-defined value C ranges from approximately 0.1 to 0.2.

5. The broadband micropatch antenna system of claim 1, wherein wave-slowing structures are located on at least one of the radiating element and the second surface.

6. The broadband micropatch antenna system of claim 5, wherein the wave-slowing structures comprise at least one of ribs and pins.

7. The broadband micropatch antenna system of claim 1, wherein wave-slowing structures are located along the perimeter of at least one of the radiating element and the second surface.

8. The broadband micropatch antenna system of claim 7, wherein the wave-slowing structures comprise at least one of extended continuous structures and series of localized structures.

9. The broadband micropatch antenna system of claim 1, wherein the radiating element is configured to operate in a linearly-polarized mode.

10. The broadband micropatch antenna system of claim 1, wherein the radiating element is configured to operate in a circularly-polarized mode.

11. A dual-band broadband micropatch antenna system operating in a first frequency band and a second frequency band, wherein the second frequency band is higher than the first frequency band, comprising:

a ground plane comprising:

a first surface having a first lateral dimension; and a cavity filled with air, the cavity comprising:

a second surface having a second lateral dimension; and a sidewall surface having a first height;

a first radiating element having a third lateral dimension, wherein the first radiating element:

is configured to operate in the first frequency band;

is laterally positioned within the cavity;

has a second height from the first surface, wherein:

the second height is greater than zero and no greater than 0.05λ, wherein λ is the free-space wavelength of the broadband micropatch antenna system;

has a third height from the second surface; and is separated from the ground plane by air; and a second radiating element having a fourth lateral dimension, wherein the second radiating element:

is configured to operate in the second frequency band;

is laterally positioned within the cavity;

has a fourth height from the first radiating element;

has a fifth height from the first surface; and is separated from the first radiating element by air;

a first conductor connected to the first radiating element and configured to input electromagnetic signals having the first frequency band to the first radiating element; and a second conductor connected to the second radiating element and configured to input electromagnetic signals having the second frequency band to the second radiating element.

12. The dual-band broadband micropatch antenna system of claim 11, wherein:

the first lateral dimension is approximately (1-1.5)λ, wherein λ is the free-space wavelength of radiation in the second frequency band.

13. The dual-band broadband micropatch antenna system of claim 11, wherein:

the second lateral dimension is determined according to the algorithm:

$$\frac{D}{\lambda} \approx \frac{l_p}{\lambda} + C,$$

wherein:

D is the second lateral dimension;

$l_p$ is the fourth lateral dimension;

C is a user-defined value; and

λ is the free-space wavelength of radiation in the second frequency band.

14. The dual-band broadband micropatch antenna system of claim 13, wherein the user-defined value C ranges from approximately 0.1 to 0.2.

15. The dual-band broadband micropatch antenna system of claim 11, wherein wave-slowing structures are located on at least one of the first radiating element and the second surface.

16. The dual-band broadband micropatch antenna system of claim 15, wherein the wave-slowing structures comprise at least one of ribs and pins.

17. The dual-band broadband micropatch antenna system of claim 11, wherein wave-slowing structures are located along the perimeter of at least one of the first radiating element and the second surface.

18. The dual-band broadband micropatch antenna system of claim 17, wherein the wave-slowing structures comprise at least one of extended continuous structures and series of localized structures.

19. The dual-band broadband micropatch antenna system of claim 11, wherein wave-slowing structures are located on at least one of the first radiating element and the second radiating element.

20. The dual-band broadband micropatch antenna system of claim 19, wherein the wave-slowing structures comprise at least one of ribs and pins.

21. The dual-band broadband micropatch antenna system of claim 11, wherein wave-slowing structures are located along the perimeter of at least one of the first radiating element and the second radiating element.

22. The dual-band broadband micropatch antenna system of claim 21 wherein the wave-slowing structures comprise at least one of extended continuous structures and series of localized structures.

23. The dual-band broadband micropatch antenna system of claim 11, wherein the first radiating element and the second radiating element are configured to operate in a linearly-polarized mode.

24. The dual-band broadband micropatch antenna system of claim 11, wherein the first radiating element and the second radiating element are configured to operate in a circularly-polarized mode.

* * * * *

UNITED STATES PATENT AND TRADEMARK OFFICE

CERTIFICATE OF CORRECTION

PATENT NO. : 8,174,450 B2
APPLICATION NO. : 12/418656
DATED : May 8, 2012
INVENTOR(S) : Tatarnikov et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 278 days.

Signed and Sealed this
Twenty-first Day of August, 2012

David J. Kappos

David J. Kappos
*Director of the United States Patent and Trademark Office*